United States Patent [19]

Diwan

[11] Patent Number: 4,654,976

[45] Date of Patent: Apr. 7, 1987

[54] RULER BELT HANGER

[76] Inventor: Nazir Diwan, 1345 Cr. Samson, Brossard, Quebec, J4X 1K7, Canada

[21] Appl. No.: 763,833

[22] Filed: Aug. 8, 1985

[51] Int. Cl.[4] ..... B43L 7/00; A41D 27/22

[52] U.S. Cl. ..... 33/485; 223/DIG. 1

[58] Field of Search ..... 223/85, 87, DIG. 1; 33/485

[56] References Cited

U.S. PATENT DOCUMENTS

| | | | |
|---|---|---|---|
| 217,190 | 7/1879 | Osborne | 33/485 |
| 1,574,953 | 3/1926 | Wood | 33/564 |
| 1,583,138 | 5/1926 | Garnett | 33/565 |
| 3,243,087 | 3/1966 | Pulitzer | 223/DIG. 1 |
| 3,997,091 | 12/1976 | Burnette | 223/87 |

FOREIGN PATENT DOCUMENTS

| | | | |
|---|---|---|---|
| 2744669 | 4/1979 | Fed. Rep. of Germany | 33/489 |
| 248765 | 3/1948 | Switzerland | 223/DIG. 1 |

*Primary Examiner*—Harry N. Haroian

*Attorney, Agent, or Firm*—Richard L. Miller

[57] ABSTRACT

The instant invention is a combination ruler and hanger for suspending belts from a display rack, and includes a long one piece body molded of plastic and having notches for the belt to extend therethrough while being wrapped over one end of the body in addition to a measuring scale and stencil cut-outs.

2 Claims, 3 Drawing Figures

RULER BELT HANGER

BACKGROUND OF THE INVENTION

This invention relates generally to hangers for use in supporting articles in displayed position from a rack. More specifically it relates to a hanger for suspending belts from a display rack in a retail store.

It is well known that garment belts offered for sale in a retail store are usually suspended from a display rack where a customer can make a selection of a preferred one from among the various designs or styles. The belt manufacturer usually attaches each belt to a hanger shaped into a hook for hanging it on the store display rack, and form where the customer can easily unhook his selected belt. After the belt is taken home, the customer then removes the belt from the hanger, for use and the hanger is discarded as being no longer useful. Numerous such belt hangers have been developed in the past, such as shown in U.S. Pat. Nos. 3,710,996; 4,063,669; and 4,453,655 to Smilow et al.

SUMMARY OF THE INVENTION

A principal object of the present invention is to provide an improved belt hanger which continues to serve a useful purpose after a customer has removed the belt therefrom.

More specifically, another object is to provide a ruler belt hanger which serves as a measuring linear scale after the belt is removed.

Yet another object is to provide a ruler belt hanger which will appeal especially to children for additional use to trace geometric designs from stencil cut-outs provided on the hanger.

Yet a further object is to provide a ruler belt hanger which, with its additional ruler, utility, serves as a promotional business item for attracting and inducing customers to select and purchase the particular belt instead of any other competitor's belt.

Other objects are to provide a ruler belt hanger which is simple in design, inexpensive to manufacture, rugged in construction and easy to use.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 1:
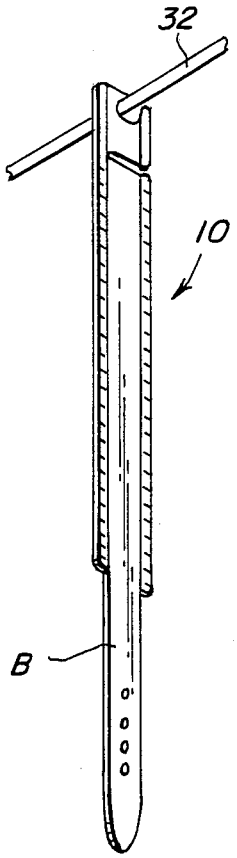
FIG. 1 is a perspective view of the invention supporting a belt for display on a rod.
Figure 2:
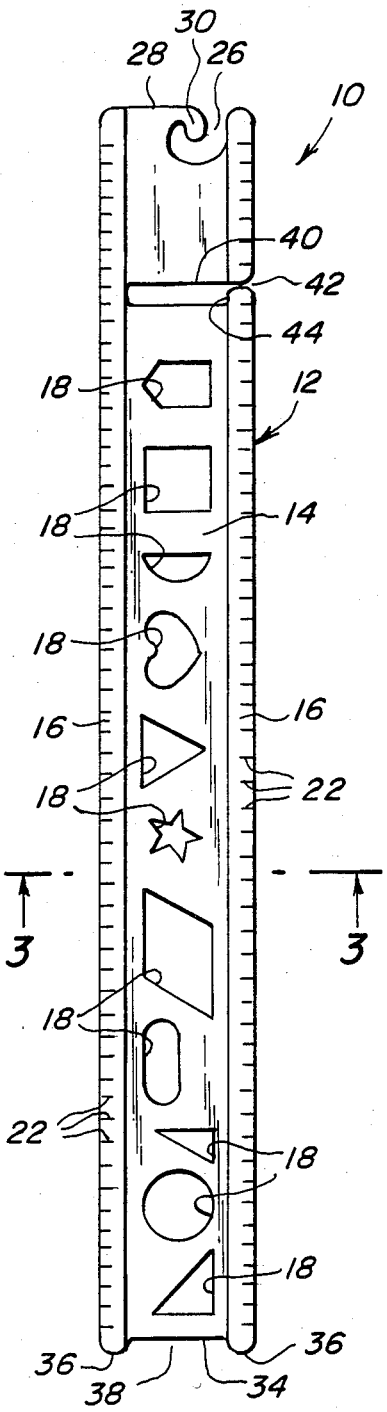
FIG. 2 is a front elevational view of the invention.
Figure 3:
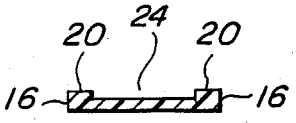

FIG. 3. is a cross sectional view taken along line 3—3 in FIG. 2.

DETAILED DESCRIPTION OF PREFERRED EMBODIMENT

Referring now to the drawing in greater detail, the reference numeral 10 represents a ruler belt hanger according to the present invention, wherein there is a one-piece body 12, preferably injection molded of plastic material in order to be very inexpensive in mass production manufacture. The body includes an elongated, flat, relatively thin, central panel 14 having a thickened rib 16 along its opposite longitudinal edges. The flat central panel includes a plurality of variously configurated geometric stencil cut-outs 18 formed along its length, so that a child may use the same as a template by inserting a pencil in a stencil cut-out and following its contour to copy the shape thereof upon a paper. Each rib is straight and generally rectangular in cross sectional configuration, and opposite sides 20 thereof are molded with increment marks 22 of various linear scales.

Each rib is raised higher than one face of the central panel, as shown in FIG. 3, so to form belt grooves 24 on one side while the opposite side of the hanger is essentially flat.

A curved notch 26 on one end edge 28 of the central panel forms a hook 30 for use in hanging the hanger from a supporting bar 32 of a display rack (not shown).

An opposite end edge 34 of the central panel is recessed from the rib ends 36 in order to form a notch 38 between the ribs. An intermediate notch 40 is formed along the body; the notch extending transversely across one of the ribs and also across the central panel, the notch accordingly opening out along one side edge 40 of the body. A rounded entry 42 to the notch is formed along the edge, so as to easily insert a belt B into the notch. The notch is narrow at its portion extending through the rib but is wide at its portion extending across the central panel, thus forming a hook 44 which serves to prevent the inserted belt from accidently falling out.

In operative use, the belt (which may be an elastic belt), is wrapped around the central panel, extending through notches 38 and 40; the belt being narrower in width than the width of grooves 24 in order to rest therein.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ruler belt hanger, comprising, in combination, an elongated one piece body having a pair of side ribs with an interconnected web having one surface recessed below the side ribs, a measuring scale formed along at least one rib, and a plurality of geometric cut-outs along said web, a hook formed at one end of said body for hanging from a display rack, the opposing end of said body having a notch defined by a recess formed longitudinally into said web leaving the side ribs projecting beyond the web, and an intermediate transverse notch adjacent said edge of said body partly there across, whereby a belt can lie flat along the body fitting into said recess and can also be wrapped around the body between said notch at the opposing end and said transverse notch.

2. The combination as set forth in claim 1, wherein said body is molded of plastic.

* * * * *